US005961100A

United States Patent [19]

Lechtenboehmer

[11] Patent Number: 5,961,100

[45] **Date of Patent: *Oct. 5, 1999**

[54] FENCE FOR ENCLOSURE AND DEMARCATION PURPOSES

[76] Inventor: Hans Lechtenboehmer, Baerier Strasse 9, D-47447 Moers, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/640,954

[22] PCT Filed: Nov. 10, 1994

[86] PCT No.: PCT/DE94/01331

§ 371 Date: May 17, 1996

§ 102(e) Date: May 17, 1996

[87] PCT Pub. No.: WO95/14144

PCT Pub. Date: May 26, 1995

[30] Foreign Application Priority Data

Nov. 18, 1993 [DE] Germany ..... 43 39 266

[51] Int. Cl.[6] ..... E04H 17/16

[52] U.S. Cl. ..... 256/24; 256/56; 256/70; 256/48

[58] Field of Search ..... 256/56, 70, 55, 256/54, 68, 24, 25, 47, 48

[56] References Cited

U.S. PATENT DOCUMENTS

| | | | |
|---|---|---|---|
| 4,361,313 | 11/1982 | Russell | 256/13.1 |

FOREIGN PATENT DOCUMENTS

| | | | |
|---|---|---|---|
| 0 472 760 | 3/1992 | European Pat. Off. . | |
| 2 264 149 | 10/1975 | France . | |
| 1 759 296 | 1/1972 | Germany . | |
| 2645905 | 4/1978 | Germany | 256/25 |
| 29 08 818 | 9/1979 | Germany . | |
| 3248438 | 7/1984 | Germany | 256/68 |
| 87 04 291 | 9/1987 | Germany . | |
| 39 20 108 | 10/1990 | Germany . | |
| 3925052 | 2/1991 | Germany | 256/47 |
| 92 05 376 | 9/1992 | Germany . | |

*Primary Examiner*—Kenneth J. Dorner
*Assistant Examiner*—William L. Miller
*Attorney, Agent, or Firm*—Foley & Lardner

[57] ABSTRACT

A fence comprises posts and lattice panels which are fixed at their vertical edges to the posts. The post carries, on its front side, hooks, on which the horizontal bars of the lattice panels rest. The lattice panels are clamped between the front side of the post and the rear side of a hollow front profile which have on the rear side, at the locations of the hooks, holes, into which hooks penetrate with a leg directed obliquely outward and upward. The upper hole edges slide downward on the slope formed on the upper side of the legs and at the same time displace the front profile toward the post. The front profile is pressed downward by a holding-down device.

7 Claims, 5 Drawing Sheets

FENCE FOR ENCLOSURE AND DEMARCATION PURPOSES

FIELD OF THE INVENTION

The invention relates to a fence for enclosure and demarcation purposes, with vertical posts successively placed along a length of the fence.

BACKGROUND OF THE INVENTION

Such a fence is known from EP 472,760 A1. In the known fence, the lattice panels comprise vertical bars, to which horizontal bars are attached on both sides at the same height. The bars consist of directional round steel wires of a diameter of 4 to 10 mm which are connected to one another at the intersection points by resistance welding. However, the invention is not restricted to this design of the lattice panels. Other cross sections can also be used as round material, and the horizontal bars attached in pairs can be replaced by profile material which gives increased bending strength in a horizontal plane, for example bars with a rectangular cross section, with a U-shaped cross section or the like.

In the generic fence, the posts can consist of a rectangular hollow profile; in this case, the hooks are attached on the front side of the hollow profile. However, the posts can also themselves consist of lattice-work; in this case, the hooks are formed by a forwardly projecting extension of horizontal lattice bars of the post. In the known embodiment, the hooks comprise a horizontal fastened leg and an upwardly angled free leg, of which the distance from the front side of the post corresponds to the outer width of two horizontal bars of the lattice panels, said horizontal bars being adjacent to one another at the same height. The lattice panels are suspended in the hooks by means of the horizontal bars and are Subsequently fixed by screws, in such a way that the double horizontal bars or the lattice panels are prevented from being removed from the hooks again. In one embodiment, after the suspension of the lattice panels the free ends of the hooks are bent over the horizontal bars in order to fix these vertically.

The known type of connection of the lattice panels to the posts, although simple, nevertheless has disadvantages. One disadvantage is that there is no guarantee that the horizontal bars will be retained under tension. They still have some play perpendicular to the fence surface on the hooks, which means that vibrations occurring under the influence of wind lead to unpleasant buzzing noises. The same is true when, for example, a ball strikes the lattice panel.

In the embodiment in which fixing is carried out by bending the free legs of the hooks, the corrosion protection of the lattice panels is put to risk. These are exposed to atmospheric conditions for many years and are carefully protected against corrosion correspondingly, for example by galvanizing and a plastic powder coating laid over this. These corrosion protection measures are impaired if the upwardly directed free legs of the hooks are bent round toward the front side of the post, whether by means of a tool or, as cannot be ruled out in practice, by means of a hammer. In this case considerable expansion of the coating occurs, and these overtax its expandability and adhesion and cause local cracks and perforations as well as peeling of the coatings. These places are the starting point for corrosion and can hardly be repaired effectively.

SUMMARY OF THE INVENTION

The object on which the invention is based is to design a generic fence in such a way that fastening is improved and the lattice panels are held on the posts without noise.

Thus, in the invention, the lattice panel is not simply supported vertically and fixed against vertical displacement, but, during the vertical displacement of the lattice panels relative to the hooks, as a result of the slope formed on these a displacement of the lattice panels simultaneously takes place perpendicularly to their surface towards the posts, so that they are not simply supported vertically, but are also braced perpendicularly to their surface. There is therefore no longer any play in this direction, so that noises caused by the wind, the impact of balls, etc. are avoided. It is important that this improvement is achieved without the use of fastening elements, such as screws or the like, which have to be fitted individually. This considerably reduces the outlay for the fence.

The hooks have some elasticity, so that any manufacturing tolerances of the lattice panels and also of the hooks can be compensated. Thus, if, for example, a hook is too closely adjacent with its slope to the front side of the post, during vertical displacement it is pressed away from the post somewhat under elastic deformation, so that equalization of bearing contact over the height of the lattice panel and uniform bracing over the entire height are established.

The expression "slope" is not only intended to refer to the situation in which the hooks run in a straight line on the effective side of their "sloping" hook leg; it is also intended to embrace hook legs extending with some curvature, in so far as the general direction of run allows the above-described function of wedge-like bracing.

The invention can be implemented in two embodiments.

In the first embodiment, an additional front profile is provided, which itself cooperates with the slopes on the hooks, in that these engage in holes of the front profile, or which carries the hooks so that these cooperate with the post.

Although the invention is already implemented if the front profile extends only over some of the height of the post, nevertheless, in the preferred exemplary embodiment, the front profile is provided over the entire height of the post. This design is advantageous especially since the lattice panels are simultaneously clamped over their entire height as a result of the actuation of the holding-down device, with the result that any rattling noises caused by relative movements between the posts and the lattice panels are avoided.

The alternative embodiment dispenses with any additional front profile. In this case, the lattice panel itself cooperates with the slope on hooks attached to the post or the hooks are formed on the lattice panel and then engaged directly on the post.

If the bracing of the lattice panel on the post is to be achieved by the sliding down via the slope and the simultaneous displacement vertically and perpendicularly to the surface of the fence or of the lattice panel, there is the further object of permanently maintaining the bracing once it has been obtained.

For this purpose, a holding element can be provided, which can at least also contribute to achieving the bracing, that is to say to achieving the vertical displacement of the front profile or of the lattice panel.

Alternative directions of attachment to the hooks can be provided, and and the hooks can be fastened to the front side of the post.

The structuring necessary for this purpose on the posts is negligible. The hooks merely need to be attached to the post profile on the front side by stud welding. There is no need, for example, to attach welding nuts or insert nuts and the like, as would be necessary in the case of a fastening of the lattice panel by means of screws. In an embodiment with an upwardly pointing free leg of the hook, the lattice panels can be suspended in the hooks in one movement. Then, either a front profile or the lattice panel itself is displaced vertically as a result of the actuation of the holding-down device, if appropriate with the assistance of a hammer blow or the like, and at the same time is pressed against the post. The fastening of the lattice panels under bracing is consequently already achieved.

However, the hooks can also be fastened to the rear side of the front profile.

In this case, the hooks engage in holes on the front side of the post profile. The advantage of this embodiment is that the front profile can be particularly flat, since, when the holding-down device is tightened, the free ends of the hooks now penetrate into the cross section of the post. The outlay in terms of the material of this embodiment is reduced.

In embodiments in which the front profile or the lattice panel is to be displaced downward during bracing, the holding element is designed as a holding-down device which presses the two elements mentioned downward relative to the post.

The design of the holding element as a molding, which is produced from metal or plastic by casting, pressing or injection molding, affords shaping possibilities which at the same time give the holding element a decorative appearance.

The dimensioning and arrangement of the hooks and associated holes ensure that, when a plate-shaped holding-down device rests on the top side of the post, the bracing of the lattice panels is also achieved simultaneously. A type of stop is thereby formed, the result of which is that there is no need to pay too great attention to the forces pulling the holding-down device onto the top of the post.

In order to exert the force which presses down the front profile or lattice panels, at least one vertical screw, which engages on the post and by means of which bracing is carried out, can be provided.

The thread for the screw can, for example, be provided by a nut welded to the inner wall of a post consisting of a hollow profile.

An embodiment of the post preferred for a whole series of reasons, such as tensibility, stackability, a good fitting surface for welding on the hooks or the presence of a sufficient inner volume for receiving the free ends of the hooks, and also on account of the smooth unbroken appearance, is that of a rectangular hollow profile.

In this case, it is recommended that the front profile also be a rectangular profile. This can be a rectangular hollow profile, if the hooks are to penetrate into the interior, or a solid rectangular profile, that is to say a flat steel bar.

The abovementioned benefits of the rectangular hollow profile are then also present in the front profile. Moreover, the two rectangular shapes complete one another most easily to form a unitary shape which gives a smooth and sturdy impression. However, other cross-sectional shapes, such as, for example, semi-circular hollow profiles, are not ruled out.

In the case of a rectangular profile as a front profile, this simply needs to be flat. Even in the design of the hollow profile, it is merely necessary, of course, to provide sufficient space inside the profile for the penetration of the hooks. According to claim 21, such a profile should be placed "flat" in front of the front surface of the post and, as is also true of other cross sections of the front profile, have the same width as the post.

For a screw engaging the upper end of the post and intended for actuating a holding-down device for the lattice panel or the front profile, a holding piece can be provided instead of the nut.

Such a holding piece can be produced in a simple way and is supported positively on the upper end of the post in the bore of the latter by means of the pin-like extension.

The plate-shaped component forming the holding element can have a hole, through which passes a screw engaging on the upper end of the front profile or of the lattice panel.

In this case, the holding element is fastened on the top side of the post and serves for pulling up the front profile or lattice panel which, for this purpose, can be designed according to claim 25.

In a first embodiment of the invention, only one series of hooks, which are located vertically one above the other and on which the edges of adjacent lattice panels rest, is provided on each post or on each front profile. In this case, the lattice panels overlap one another in a vertical edge region. This comes under consideration particularly when the lattice panels have vertical single bars and horizontal double bars on both sides of the vertical single bars. In this case, the front horizontal bars of one lattice panel and the rear horizontal bars in the adjacent lattice panel can be omitted in a vertical edge region. If these edge regions overlap one another, the total thickness of the lattice structure is no greater, even in the overlap region, than in the free lattice region, where it is determined essentially by the three-wire construction. In said embodiment, therefore, the latticework has essentially the same thickness everywhere.

Another embodiment coming under consideration is provided for lattice panels which butt flush against one another at the vertical edges.

In this case, there are two juxtaposed rows of hooks located vertically one above the other, one lattice panel engaging with its vertical edge into the hooks facing it and the other lattice panel engaging with its vertical edge into the other hooks.

The terrain on which the fence is erected is not always exactly horizontal. Also, it is not always desirable for the lower edge of the lattice panels always to be the same height above the ground.

The design using a plate-shaped component having at least one hole for the passage of a screw engaging the upper end of the front profile or the lattice panel, makes adaption easier in the situations mentioned. If the fence has to be erected on an incline, the incline can be mastered by arranging successive lattice panels in steps in a manner offset in height relative to one another. In the case of the reduced spacing of the hooks, the steps do not need to correspond exactly to the vertical spacing of the lattice panels. This, of course, also applies to the mounting of lattice panels in flat terrain, but at different heights.

As already mentioned, the invention comprises two fundamental embodiments, namely with and without a front profile.

The latter embodiment can be implemented such that the hooks are attached to the post. The lattice panel is displaced vertically, in particular is laid onto upwardly pointing hooks and is displaced downward. This results, by the simplest means, in simultaneous fixing at all the fixing points.

The forming of the free legs of the hooks attached to the post into an eye reduces the risk of injury in the simplest possible way. In this case, the free end of the eye can run obliquely and form the slope which brings about the bracing.

The advantage of this embodiment is that the slope has some elasticity and tolerances in the design and attachment of the hooks can be compensated. It is therefore possible in this embodiment, without an excessive amount of force, to ensure that a resilient bracing of the lattice panel against the post occurs at all the fixing points, irrespective of the tolerances.

Particularly in this embodiment, in which the hooks and horizontal bars of the lattice panel therefore cooperate directly, but not solely in this embodiment, the holding element can be a clamping clip which engages on the hook and the horizontal bars cooperating with this and which pulls the horizontal bars and hooks vertically toward one another.

In exactly the same way as the embodiment with a front profile in which the hooks can be attached selectively to the post or to the front profile, the embodiment in which the hooks are attached to the lattice panel and engage in a hole in the front wall of a post consisting of a hollow profile, is also of importance.

As already mentioned, the hook legs forming the slope can run in a straight line or also curvedly, as long as, during the relative movement along the post, pressure against the post occurs simultaneously.

Not only the separate features mentioned in the individual claims, but also any combinations of these features with one another are essential to the invention.

BRIEF DESCRIPTION OF THE DRAWINGS

Exemplary embodiments of the invention are represented in the drawings.

DETAILED DESCRIPTION OF THE PREFERRED EMBODIMENT

Figure 1:
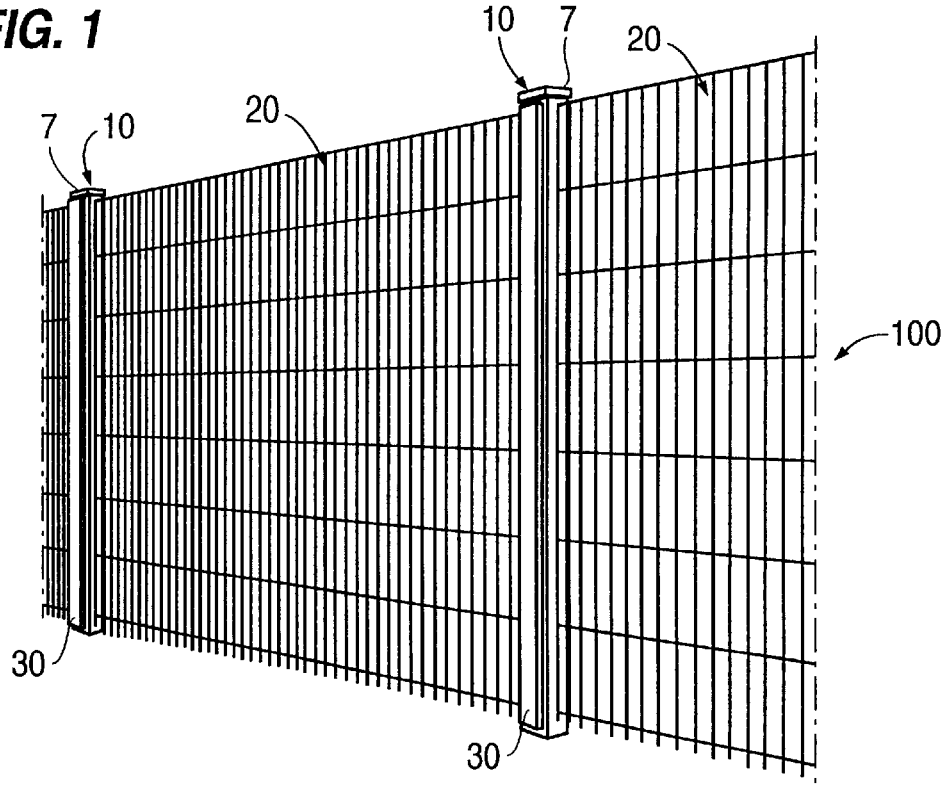
FIG. 1 shows a perspective view of the fence according to the invention.

Of the fence designated as a whole by 100 in FIG. 1, FIG. 1 shows two fence posts 10, between which extend rectangular lattice panels 20 which form the fence surface and which are firmly clamped at their vertical edges to the fence posts 10.

Figure 3:
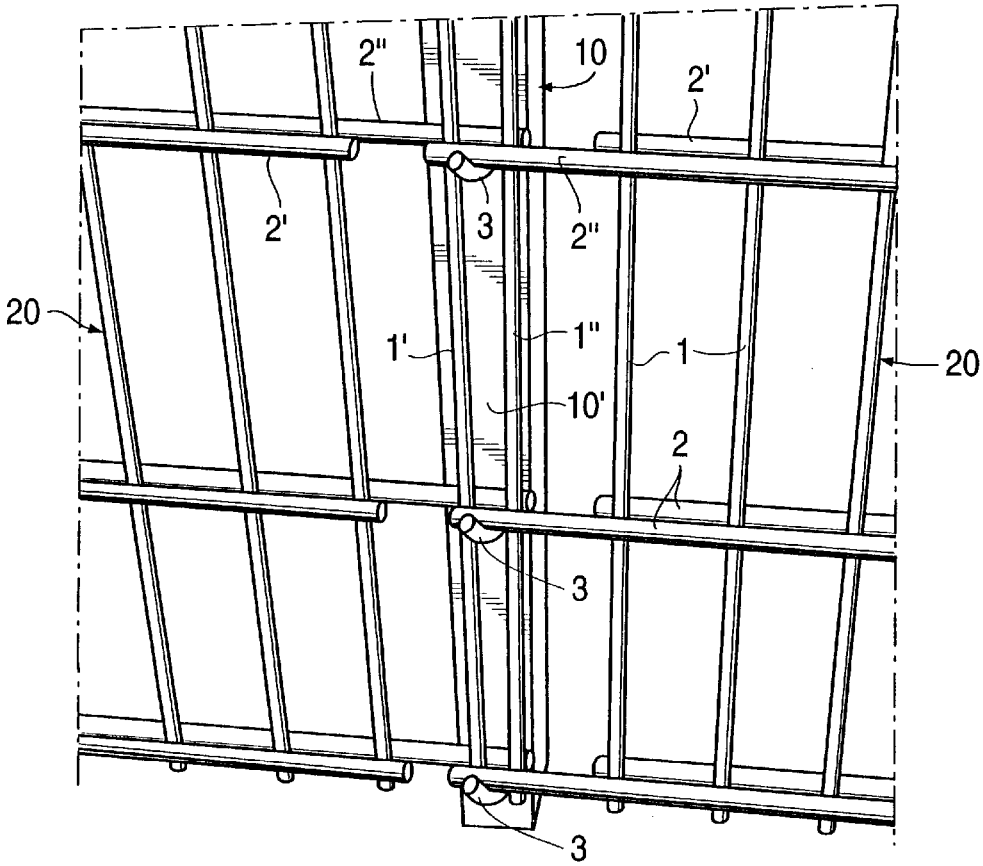
FIG. 3 shows a perspective part view of the attachment of the lattice panels to the fence post, with the front profile removed.

As is evident from FIG. 3, the lattice panels 20 consist of vertical lattice bars 1 and of horizontal lattice bars 2 which are arranged in pairs on both sides of these at the same height and which stiffen the lattice panel 20. The lattice bars 1 and 2 are connected to one another at the intersection points by resistance welding on a lattice welding machine. After the welding operation, the lattice panel 20 undergoes the conventional measures for corrosion protection, such as galvanizing and/or powder coating.

It is evident from FIG. 3 that, in that edge region of the right-hand lattice panel 20 adjacent to the post 10, the respectively rear horizontal bars 2' are somewhat shorter than the front horizontal bars 2" which, at the left-hand edge of the right-hand lattice panel, are connected solely to the last vertical bar 1' located there. This situation is reversed in the case of the left-hand lattice panel 20 in FIG. 3. Here, the respectively shortened horizontal bars 2' are those at the front and the longer horizontal bars 2" are those at the rear which are connected with their free end solely to a vertical bar 1" located there. The lattice panels 20, 20 overlap one another with their vertical edges in such a way that, according to FIG. 3, the vertical bar 1' belonging to the right-hand lattice panel 20 is located to the left of the vertical bar 1" belonging to the left-hand lattice panel 20. The total thickness of the arrangement is exactly the same in the overlap region as in the free region of the two lattice panels 20 consisting of the two horizontal bars 2' and 2" and the vertical bars 1' and 1" located between them.

As can be inferred from FIG. 3, on the plane front surface 10' of the post 10 formed by a rectangular hollow profile (for example, 40×60×2 mm), hooks 3 located one above the other in a row in the middle of each of the front surfaces 10' are provided, said hooks being butt-welded on to the front surface 10 by means of stud welding. In the detail of FIG. 3, that is to say in the lower region of the post 10, the vertical spacing of the hooks 3 corresponds to that of the lattice panels 20, that is to say a hook 3 is provided at a suitable height for each pair of horizontal bars 2, 2. The spacing of the lattice panels 20 can, for example, be 200 mm vertically and 50 mm horizontally.

In the state reproduced in FIG. 3, the lattice panels 20 are still merely laid onto the hooks 3. In this exemplary embodiment, the fastening of the lattice panels 20 to the posts 10 takes place by means of front profiles 30 which are likewise designed as rectangular hollow profiles (for example, 20×40×2 mm) and which are arranged with the flat side overlapping in front of the post 10. The front profiles 30 extend over the entire height of the posts 10. The front profiles 30 serve for bracing the lattice panels 20 on the front surface 10' of the posts 10.

Figure 2:
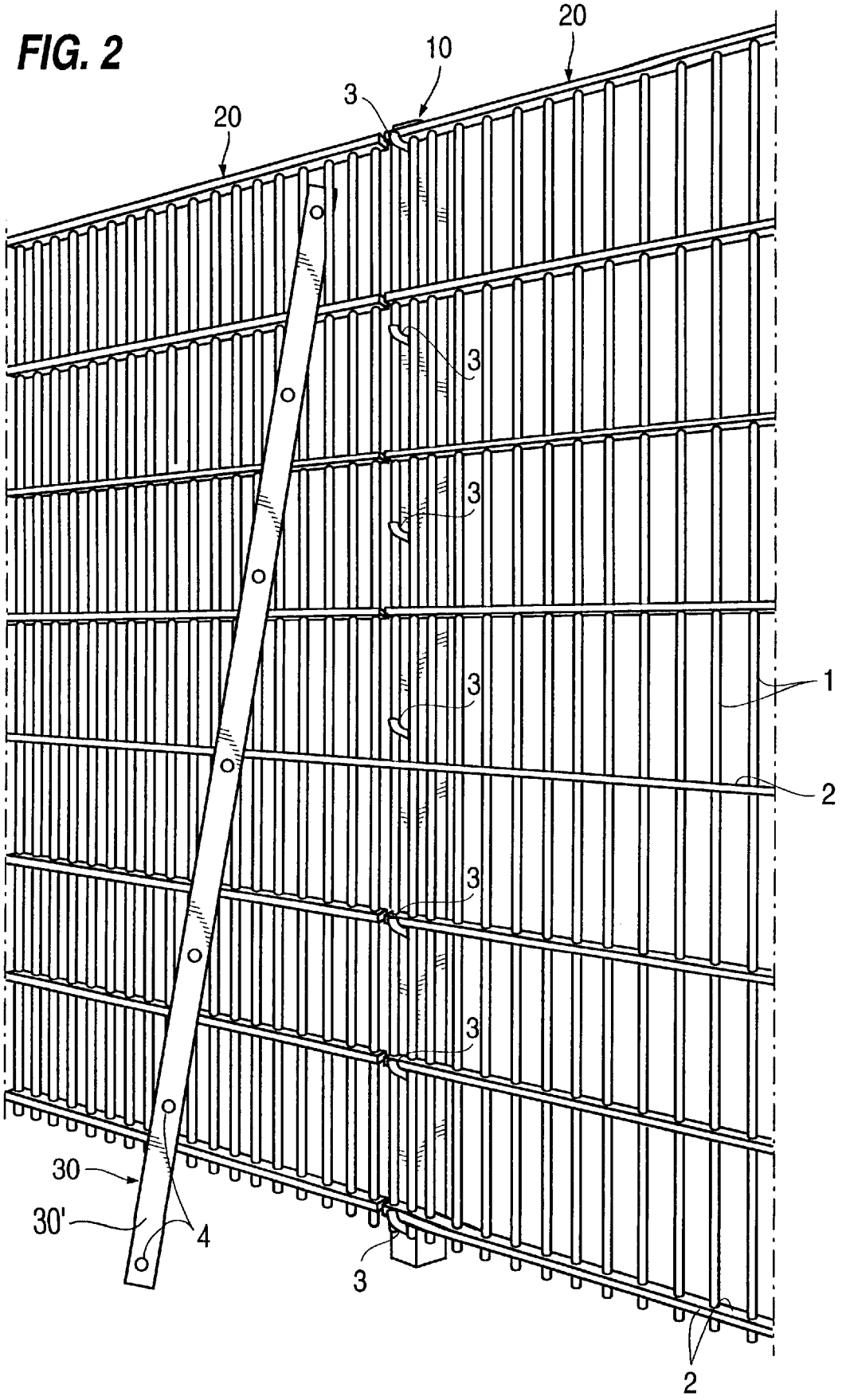
FIG. 2 shows a detail of FIG. 1 with the front profile removed.

For this purpose, the front profiles 30 are provided on the rear side with holes 4 which are situated at the locations of the hooks 3. In FIG. 2, a front profile 30 is leant loosely against a lattice panel 20. The holes 4 are located only on the side facing the front surface 10' of the post 10 in the mounted state, whilst the other three sides of the front profile 30 are intact and smooth. Only these smooth sides can be seen by the observer who otherwise sees no fastening means, as is evident from FIG. 1.

Figure 4:
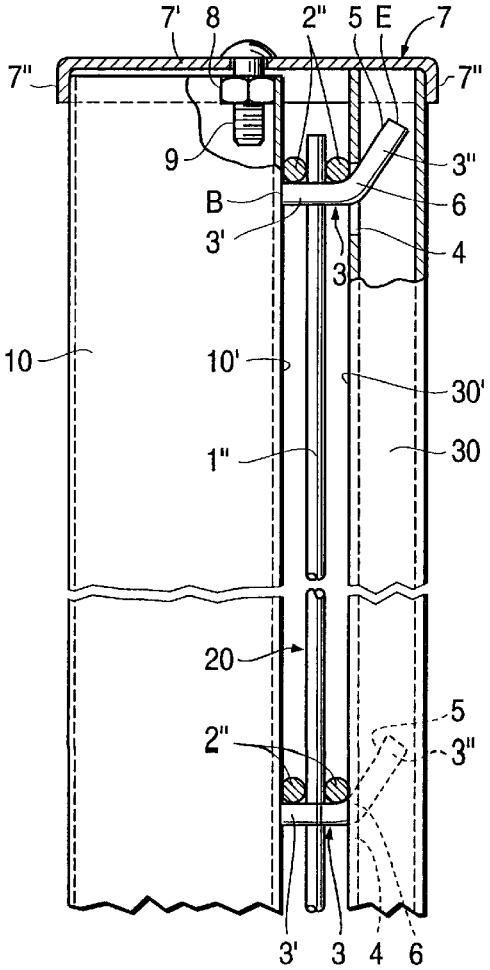
FIG. 4 shows a side view of the upper end of a fence post, partially in section.

The function of the front profile 30 is explained in FIG. 4. The hooks 3 project from the front surface 10' of the post 10. They consist of a leg 3' extending perpendicularly to the front surface 10' and fastened, that is to say welded on, at the end B, and of a bent free leg 3" which points obliquely upward in the exemplary embodiment and on the top side of which, facing the front surface 10' of the post 10, a slope 5 is formed. The slope 5 thus approaches the front side 10' of the post 10 from the end E of the free leg 3" toward the fastened leg 3'. The holes 4 provided in the rear side 30' of the front profile 30 are sufficiently large to ensure that, after the lattice panels have been laid onto the hooks 3 or the horizontal legs 3' of these, the legs 3" pointing obliquely upward can be introduced without difficulty into the interior of the hollow front profile 30. In this case, the upper hole edge 6 rests on the slope 5. Under a force pressing the front profile 30 downward, the hole edge 6 slides downward via the slope and simultaneously toward the front surface 10. During the pressing down, therefore, the front profile 30 is simultaneously displaced toward the post 10, so that the lattice panels 20,20 are firmly clamped with their mutually adjacent vertical edges between the front surface 10' of the post 10 and the rear side 30' of the front profile 30. Since the front profile 30 preferably extends over the entire length of the post 10, the lattice panel is clamped over its entire height between the post 10 and the front profile, with the result that rattling noises are avoided.

Figure 6:
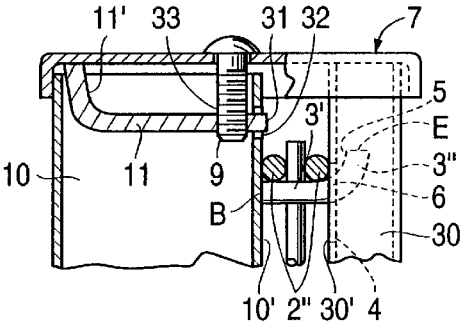
FIG. 6 shows another embodiment of the fastening of the holding-down device.

The slopes 5 of the hooks 3 do not have to run in a straight line, as represented in most of the exemplary embodiments and particularly in FIG. 4. FIG. 6 shows an upwardly bent hook leg 3'", the "slope" 5 of which is curved upward. The wedging effect at the hole edge 6 likewise occurs here. It is important only that the hole edge 6 locally meets a countersurface in the correct angular position, in order, when the front profile 30 is pressed down, simultaneously to generate the pressure against the post 10. This relates to situations in which a round hook leg 3'" is intentionally welded on, as well as situations in which, as in FIG. 4, straight hook legs 3'", although desirable, have nevertheless turned out to be somewhat curved on account of manufacturing difficulties. As long as the general direction is correct, all these embodiments can be employed. This applies to all the forms of construction of the fence which are shown.

Figure 5A:
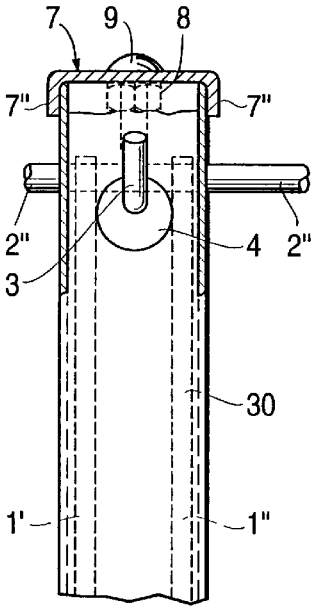
FIG. 5*a* shows a view according to FIG. 4 from the right, partially in section according to a first embodiment.

In order to cause the front profile 30 to be pressed down or in order to fix a pressed-down position of the front profile 30, a corresponding holding element is provided in the form of a holding-down device 7 which consists of a rectangular sheet metal plate 7", the edges 7" of which are angled downward. The rectangular sheet metal plate 7' exactly covers the plan contour of the post 10 and of the front profile 30 attached in front of the latter, the edges 7" both engaging round on the outside in bearing contact. In the exemplary embodiment of FIGS. 4, 5*a* and 5*b*, inside the post 10 a nut 8 is welded to its wall forming the front surface 10", a screw 9 being screwable into said nut, said screw pulling the holding-down device 7 down from above against the upper end of the post 10 and simultaneously pressing the front profile 30 downward. The dimensioning of the hooks 3 is such that, when bearing contact on the upper end of the post is obtained, the vertical edges of the lattice panels 20,20 are also optimally braced between the front surface 10' of the post 10 and the rear side 30' of the front profile 30. In the exemplary embodiment, the slope 5 of the upwardly and outwardly angled leg 3" forms with the horizontal an angle of about 60. The length of the leg 3' of the hook 3 must be dimensioned in such a way that it is somewhat smaller than the thickness of the lattice panels 20,20, so that the rear side 30' of the front profile 30 therefore already bears on the front side of the front horizontal lattice bar 2" before the upper hole edge 6' has reached the height of the top side of the leg 3' perpendicular to the front surface 10'. It must therefore still be possible for a displacement of the front profile 30 toward the post 10, brought about by the slope, to take place when the first contact of the rear side 30' with the horizontal bars 2" has occurred.

It is evident in FIG. 3 that the hooks 3 pass through between the end vertical bars 1', 1" of the lattice panels 20. The two lattice panels 20 are thereby fixed against being pulled away from the post 10 horizontally. In this case, only one row of hooks 3 located vertically one above the other is provided in the middle of the front surface 10', as is also represented in the FIG. 5*a*.

Figure 5B:
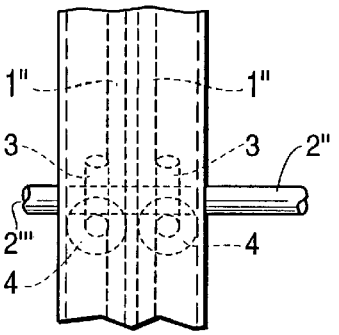
FIG. 5*b* shows a view according to FIG. 4 from the right, partially in section, according to a second embodiment.

As is evident from the bottom half of FIG. 5*b*, in an alternative embodiment two hooks 3 are in each case provided next to one another at the same height and engage on the vertical edges of lattice panels which butt flush against one another and of each of which only a horizontal wire 2'" and an end vertical wire 1" are indicated. It goes without saying that, in such cases, the front profile 30 has in each case two holes 4 located next to one another on its rear side which cannot be seen in FIGS. 5*a* and 5*b*.

FIG. 6 shows a view of the upper end of the post 10 according to FIG. 4, but in this case the screw 9 for the holding-down device 7 does not engage on a nut welded to the post 10, but in the threaded bore of a holding piece 11 consisting of an angled flat iron bar which possesses, at the end located opposite the angling 11', a centrally projecting pin-like extension 31 which engages into a transverse bore 32 of the post 10. The distance of the upper edge of the transverse bore 32 from the upper end of the post 10 and the height of the angling 11' are identical, so that, when the sheet metal plate 7' rests on the plane end of the post 10, the screw 9 can pass vertically through the holding piece 11 in the way evident from FIG. 6, in the threaded bore 33 located near that wall of the post 10 which forms the front side 10', and no constraints occur.

Figure 7:
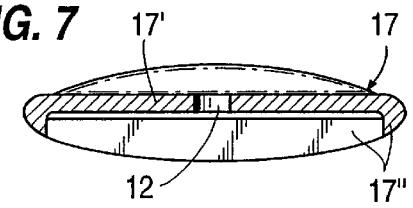
FIG. 7 shows a side view of a holding-down device designed as a molding, partially in section.
Figure 8:
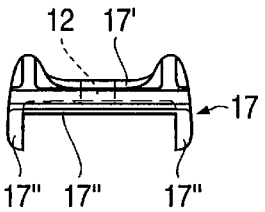
FIG. 8 shows a view according to FIG. 7 from the left.

The holding-down device 17 of FIGS. 7 and 8 consists of an aluminum casting which comprises a plate-shaped part 17' covering the plan contour of the post 10 and of the front profile 30 and downwardly projecting edges 17" which engage round the post 10 and the front profile 30 on the outside in bearing contact. By virtue of the freedom of design in casting or similar forming methods, the holding-down device 17 can be given a decorative appearance and also particular resistance which makes it possible, in order to press down the front profile 30, to make use not only of the screw 9 alone, but also of a hammer blow. The screw 9 passes through the plate-shaped part 17' in a bore 12.

Figure 9A:
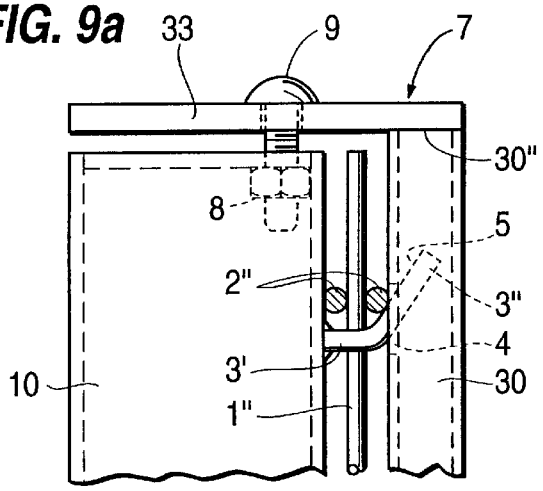
FIG. 9*a* shows a view of a further embodiment of the holding-down device in a lateral mode of representation corresponding to FIG. 4, according to a first embodiment of the hooks and of the front profile.
Figure 9B:
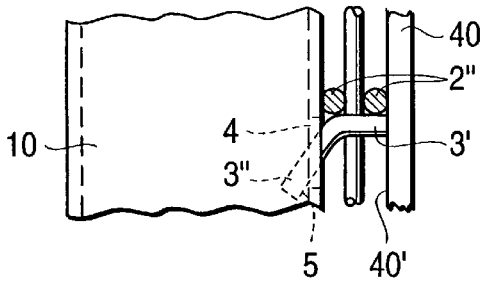
FIG. 9*b* shows a view of a further embodiment of the holding-down device in a lateral mode of representation corresponding to FIG. 4, according to a second embodiment of the hooks and of the front profile.

FIGS. 9*a* and 9*b* represents a further embodiment of a fence according to the invention, in which the holding-down device 7 consists of a plate-shaped component 33 which is welded to the upper horizontal end 30" of the front profile 30. According to the exemplary embodiment represented in FIGS. 4 and 5 and described further above, the holding-down device 7 thus formed is pulled down by means of a screw 9 which engages into a nut 8 welded on the inside of the front wall of the post 10. In this exemplary embodiment too, therefore, a downwardly directed force is exerted on the front profile 30 as a result of the tightening of the screw 9. As represented in FIG. 9*a*, the hooks 3 can then be angled upward and be welded to the carrier or, as represented in FIG. 9*b*, be angled downward and welded to the front profile 40, designed here as a solid rectangular profile, that is to say as a portion of a flat steel bar. The holes 4 are then fashioned in the post 10.

Figure 10:
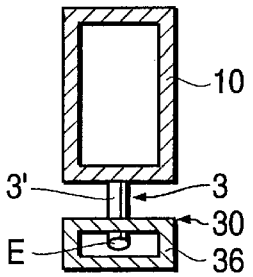
FIGS. 10 to 13 show a view from above of various embodiments of a post with a mounted front profile.
Figure 11:
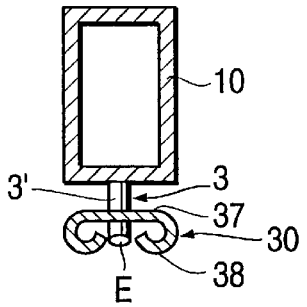
Figure 12:
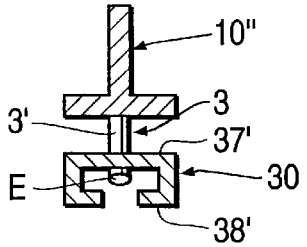

FIGS. 10 to 13 represent various possible embodiments of the post 10 and of the front profile 30 in horizontal cross section. According to FIGS. 10 and 11, the post 10 is once again produced from a rectangular hollow profile. FIG. 12 shows a post 10" consisting of a solid T-profile, the hook 3 being fastened either to the cross bar of the "T" (as shown in FIG. 12) or else to the web of the "T". A design of the post 10'" as a lattice element (FIG. 13) consisting of two pairs of vertical bars 34, 34' located opposite one another is also possible, horizontal transverse bars 35 firmly connected to the vertical bars being arranged between the pairs. The transverse bars 35 project beyond the vertical bars 34, 34' toward the front side 10' of the post 10'" and are angled vertically, so that their projecting parts 35' form the hooks 3.

Figure 13:
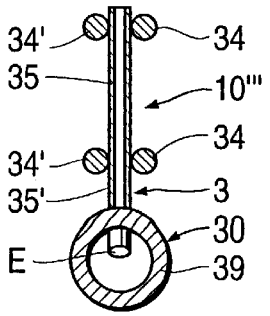

Furthermore, FIGS. 10 to 13 show various embodiments of front profiles which, in each case, can be used with the various posts 10, 10", 10'" also in combinations other than those shown in the drawing. In FIG. 10, the front profile 30 is formed by a flat rectangular hollow profile 36 which has the holes for receiving the hooks in a wall facing the post. This embodiment therefore corresponds to FIGS. 4 to 6 and FIGS. 9*a* and 9*b*. However, as represented in FIGS. 11 and 12, it is also possible to use as front profile 30 a C-profile 37, 37', the lateral edges 38, 38' of which are bent round forward through at least 180°, so that the free ends E of the hooks 3 do not project beyond the front limiting surface of the front profile 37, 37'. Also, as represented in FIG. 13, a tubular design 39 of the front profile can be employed.

Figure 14A:
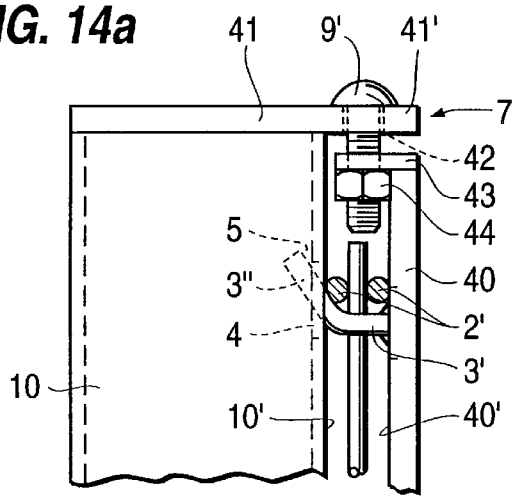
FIG. 14*a* shows a side view of a further embodiment of a fence post with a holding-down device, according to a first embodiment hook and front profile arrangements.
Figure 14B:
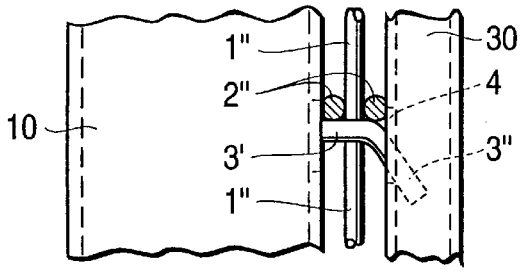
FIG. 14*b* shows a side view of a further embodiment of a fence post with a holding-down device, according to a second embodiment of hook and front profile arrangements.

FIGS. 14*a* and 14*b* represents, in the upper part of the illustration, an exemplary embodiment of the fence according to the invention in which the hooks 3 are fastened to the front profile 40 designed as a solid portion of a flat steel bar. The holes 4 are fashioned in the posts 10. In this embodiment, there serves as a holding element a plate-shaped component 41 which is welded to the horizontal upper end of the post 10 and which, again, covers the plan contour of the post 10 and of the front profile 40. In the region 41' projecting beyond the front side 10' of the post 10, the plate-shaped component has a bore 42, through which a screw pushed in from above engages. Welded to the upper end of the front profile 40 is a molding 43 which projects inward, that is to say toward the front side 10' of the post 10, and which has a bore for the passage of the screw 9' which can be screwed into a nut 44 arranged underneath. By tightening the screw 9', the front profile 40 can be pulled up relative to the post 10 in such a way that it is simultaneously pressed in the direction of the post 10 as a result of the engagement of the slopes 5 of the hooks 3 on the upper edge of the holes 4. In this embodiment, in which an upwardly directed force is therefore exerted on the front profile 30, 40 during the tightening, it is likewise possible, as represented in FIG. 14*b*, to attach the hooks 3 to the posts 10, in which case the hooks are angled downward and engage in the holes 4 arranged in the front profile 30.

As is evident from FIG. 2, the spacing of the hooks 3 does not correspond completely to the spacing of the horizontal bars 2 of the lattice panels 20. The lower three hooks 3 and the uppermost hook 3 carry horizontal bars 2 in each case. However, the remaining hooks 3 are situated at other locations, this being intended to allow a mounting of the lattice panels 20 at differing heights or a height offset of lattice panels 20 adjoining one another, when the fence is erected on terrain with an incline. In the exemplary embodiment, the vertical spacing of the lattice panels 20 is 200 mm. However, the second hook 3 from the top is at a distance of 250 mm from the uppermost hook 3, and this spacing of 250 mm is also maintained in the case of the two hooks 3 located underneath. For absorbing the weight of the lattice panel 20 and for suspension during mounting, it is sufficient if a lattice panel rests only on one hook 3. As a result of the arrangement shown, it is possible, for example, to suspend the right-hand lattice panel 20, 50 mm lower than the left-hand lattice panel by laying it onto the second hook 3 from the top. Laying onto the hook 3 located underneath allows stepping of 100 or 150 mm.

When the embodiment according to FIGS. 1 to 8 is being mounted, the lattice panels 20 are laid onto the hooks 3 in the desired way. The front profile 30 is then brought into position in front of each post, the hooks 3 penetrating into the bores 4. Then, as a result of the tightening of the screw 9, if appropriate with the assistance of an appropriate hammer blow, the downward vertical displacement of the front profile 30 and the bracing of the lattice panel against the front surface 10' of the post 10 are brought about. Mounting is already terminated thereby. There is therefore no need to screw in a multiplicity of screws or for similar mounting operations. The finished fence is distinguished by a smooth and sturdy appearance. No fastening means are visible. The front profile 30 has the same width as the fence post 10 and visually forms a unit with this.

Figure 15:
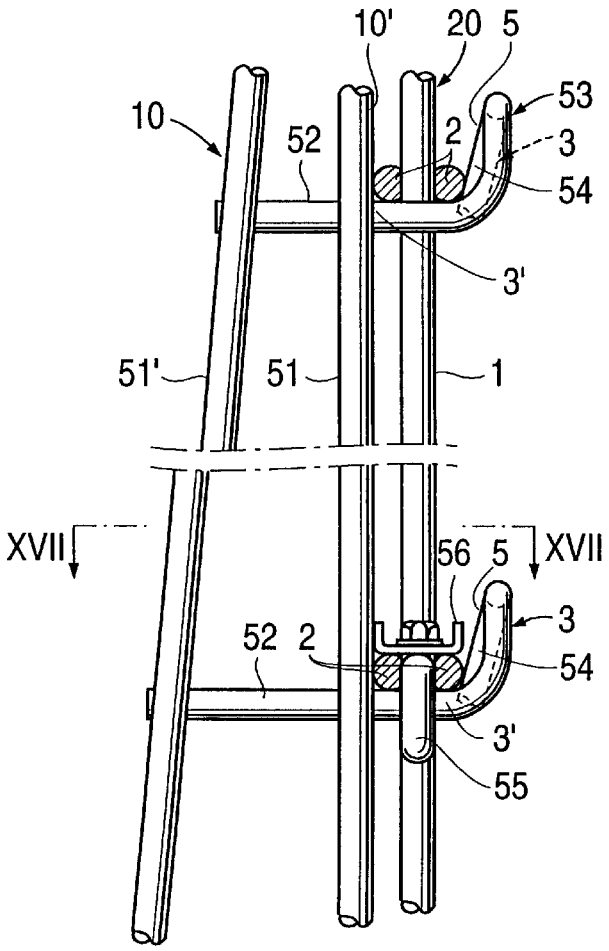
FIG. 15 shows a partial side view of a post consisting of lattice material.
Figure 16:
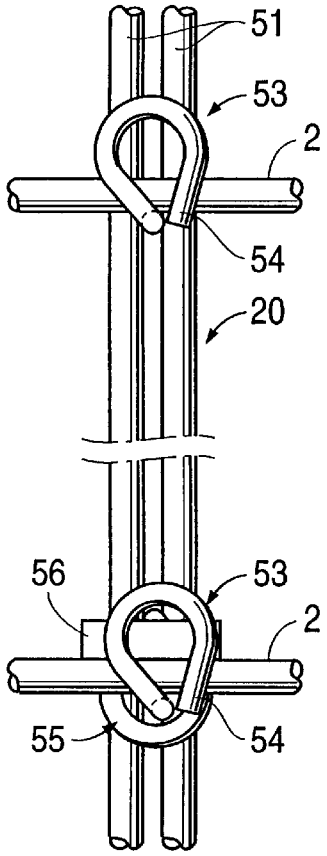
FIG. 16 shows a view according to FIG. 15 from the right.
Figure 17:
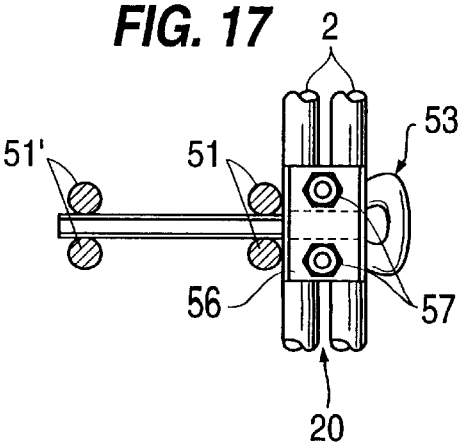
FIG. 17 shows a horizontal section along the line (XVII—XVII) in FIG. 15.

FIGS. 15 to 17 represent an exemplary embodiment which differs from the previous exemplary embodiments in two respects: on the one hand, in this case, the post 10 does not consist of a rectangular hollow profile, but itself consists of lattice material with vertical bars 51, 51' located opposite one another in pairs and with horizontal bars 52 which extend between these and which project beyond the front side 10' of the post 10 and form the hooks 3 there. The surface of the lattice material of this post 10 extends perpendicularly to the fence surface. A suitable termination is provided at the upper end of this post 10. At the lower end, fixing to a foundation takes place in the usual way.

The forwardly projecting ends of the horizontal bars 52 form the "fastened" legs 3' of the hooks 3. The "free" legs 3' [sic] are bent to form an upwardly directed eye 53 which extends essentially parallel to the fence surface and which reduces the risk of injuries at the hook ends. The free end 54 of the bar 52 forming the eye 53 extends downward and obliquely toward the front side 10' of the post 10. The top side of the free end 54 forms the slope 5.

The lattice panel 20 is suspended in the hooks 3. The dimensioning of the hook 3 is such that the respectively front horizontal bar 2 of the lattice panel 20 bears on the slope and the opposite rear horizontal bar 2 simultaneously butts against the front side 10' of the post 10 before the horizontal bars 2,2 rest on the top side of the fastened leg 3'.

The free end 54 of the eye 53 is displaceable outwardly and elastically, so that, when a force directed vertically downward is exerted on the lattice panel 20, the respectively front horizontal bar 2 slides down forward on the slope 5, with the free end 54 being pressed slightly away, until bearing contact on the leg 3' is obtained. The lattice panel 20 is then clamped resiliently and in a play-free manner with its horizontal bars 2,2 between the front side 10' of the post 10, said front side being formed by the vertical bars 51.

In the exemplary embodiment, this bracing position is fixed by a holding element 55, 56 which is attached to at least one of the hooks 3 located one above the other and which comprises a U-shaped shackle 55 which engages under the fastened leg 3' of the hook 3 and has threaded legs and which passes through between the horizontal bars 2,2 resting on the leg 3'. Those ends of the legs which project beyond the horizontal bars 2,2 pass through a U-profile 56 resting on the horizontal bars 2,2 and are screwed thereby means of nuts 57 (FIG. 17).

It goes without saying that, in order to hold the lattice panel 20 down in the bracing position reproduced in FIGS. 15 and 16, other holding-down devices of the type already previously described can also be used if appropriate in addition to the holding elements 55, 56, 57.

Figure 18:
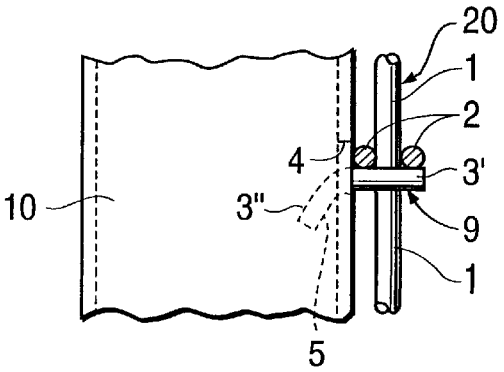
FIG. 18 shows a partial side view of a further embodiment.

The embodiment according to FIG. 18 shows a post 10 consisting of a rectangular hollow profile and hooks 3 fastened to the lattice panel 20 and having free legs directed toward the front side 10' of the post 10 and downward. The lattice panels 20 are guided with the hooks 3 through correspondingly positioned and dimensioned holes 4 in the front side 10' of the post 10 and are then pressed downward. The dimensioning and arrangement of the hooks 3 are such that the free legs 3" having the slope 5 sit on the lower edge of the holes before the fastened leg 3' does. In this way, the lattice panel 20 can be displaced some distance downward under the elastic deformation of the free leg 3", in order to exert on the lattice panel 20 a bracing force directed perpendicularly toward the front side 10' of the post 10.

What is claimed is:

1. A fence having a plurality of vertical posts extending in a first direction arranged at intervals along a length of the fence, and lattice panels mounted to adjacent ones of the vertical posts and comprising a plurality of intersecting bars, the fence further comprising:

at least one hook attached to and forming a wedge-like clamp with each vertical post, each hook including a fastened section and a bent section, the fastened section being attached to the post at a first end and extending in a second direction, perpendicular to the first direction, from the post to a second end, and the bent section having at least a portion extending in a sloping direction relative to and immediately adjacent to the second end of the fastened section, the sloping direction being between the first direction and the second direction;

the lattice panel being mounted to the fence post by sliding along the bent section of the hook to the fastened section and being supported by the fastened section to form the wedge-like clamp;

each lattice panel including a horizontal bar extending in the second direction, and when mounting the lattice panel to the fence post, the horizontal bar sliding along the bent section of one of the hooks; displacement of the lattice panel in the first direction and the second direction occurring during sliding of the horizontal bar along the bent section;

the bent section of the hook being formed in a substantially closed eve extending substantially parallel to the post to which the hook is attached; and a free end of the closed eye extending toward the fastened section at a constant angle of slope such that the free end is non-perpendicular to the fastened section.

2. The fence as claimed in claim 1, wherein the hook is attached to a front side of the post.

3. The fence as claimed in claim 1, wherein the hook supports two adjacently mounted lattice panels, and vertical edges of the adjacently mounted lattice panels overlap in a vicinity of the hook.

4. The fence as claimed in claim 1, wherein the plurality of intersecting bars includes a plurality of horizontal bars having a first spacing, and the at least one hook includes a plurality of hooks having a second spacing, and wherein the first spacing is a fraction of the second spacing.

5. The fence as claimed in claim 1, wherein as the horizontal bar of the lattice panel slides in the first direction along the bent section of the hook, displacement of the lattice panel toward the vertical post occurs in the second direction.

6. The fence according to claim 1, further comprising a clamping clip which engages the hook and the horizontal bar.

7. The fence according to claim 1, wherein the sloping direction is at a constant angle.

* * * * *